US005542394A

United States Patent [19]

Tomisawa

[11] Patent Number: 5,542,394

[45] Date of Patent: Aug. 6, 1996

[54] VEHICLE ENGINE REFUELING DETECTION APPARATUS AND METHOD AND FUEL SUPPLY APPARATUS AND METHOD

[75] Inventor: Naoki Tomisawa, Atsugi, Japan

[73] Assignee: Unisia Jecs Corporation, Atsugi, Japan

[21] Appl. No.: 422,508

[22] Filed: Apr. 13, 1995

[30] Foreign Application Priority Data

Apr. 15, 1994 [JP] Japan ..... 6-077342

[51] Int. Cl.[6] ..... F02D 45/00

[52] U.S. Cl. ..... 123/491; 123/510; 137/557; 137/558

[58] Field of Search ..... 123/1 A, 179.16, 123/491, 494, 510; 137/557, 558; 73/113, 114, 290 R, 299; 141/94, 95; 364/442

[56] References Cited

U.S. PATENT DOCUMENTS

| | | | |
|---|---|---|---|
| 4,611,287 | 9/1986 | Kobayashi et al. | 364/442 |
| 5,029,622 | 7/1991 | Mutter | 141/94 X |
| 5,035,219 | 7/1991 | Ohkumo et al. | 123/425 |
| 5,090,389 | 2/1992 | Oota | 123/1 A X |
| 5,301,648 | 4/1994 | Uchinami | 123/491 |
| 5,331,994 | 7/1994 | Bryan, III et al. | 137/558 X |
| 5,383,500 | 1/1995 | Dwars et al. | 141/94 X |

FOREIGN PATENT DOCUMENTS 5-195840 8/1993 Japan .

*Primary Examiner*—Tony M. Argenbright
*Attorney, Agent, or Firm*—Foley & Lardner

[57] ABSTRACT

A value for a quantity of fuel remaining in a fuel tank is stored when a key switch is switched off. Refueling while an engine is stopped is detected when a difference between a remaining fuel quantity value for when the key switch is switched on and the stored remaining fuel quantity value for when switched off is equal to or greater than a predetermined proportion of the stored remaining fuel quantity value for when switched off. When refueling has been carried out, the fuel property is newly detected based on engine operating conditions, while when refueling has not been carried out, the fuel property is considered to be unchanged, and a fuel supply quantity is controlled in accordance with a fuel property for the previous time.

21 Claims, 5 Drawing Sheets

VEHICLE ENGINE REFUELING DETECTION APPARATUS AND METHOD AND FUEL SUPPLY APPARATUS AND METHOD

FIELD OF THE INVENTION

The present invention relates to a vehicle engine refueling detection apparatus and method, and a fuel supply apparatus and method. More particularly, the present invention relates to an apparatus and method for detecting whether or not an engine fuel tank has been refueled, and to an apparatus and method for appropriately controlling a fuel supply quantity to correspond to changes in properties of the fuel due to refueling.

DESCRIPTION OF THE RELATED ART

In controlling the fuel supply to an engine, it is known that an appropriate fuel supply quantity will differ depending on differences in the fuel properties, and in particular the vaporization characteristics.

To deal with different vaporization characteristics, Japanese Unexamined Patent Publication No. 5-195840 discloses a construction for obtaining a fuel quantity increase correction amount to suit the properties of the fuel being used, by reducing a fuel quantity increase correction amount corresponding to water temperature as much as possible within a range wherein the engine surge torque does not exceed a permissible value.

Moreover, the present applicant has previously proposed an apparatus which determines the vaporization characteristic of a fuel by detecting a change in combustion pressure when the fuel supply quantity to the engine is forcibly changed over a predetermined period and a response delay of an air-fuel ratio change which varies depending on differences in vaporization characteristics of the fuel.

However, with the above constructions having no sensor for direct detection of the fuel property, but relying instead on indirect detection of the fuel property from engine operating conditions, and then changing the fuel supply characteristics, the fuel supply cannot be controlled to suit to the fuel property, until sufficient time has elapsed from engine start-up to enable detection of the fuel properties.

Therefore during the interval from start-up until the fuel property is specified, it is not possible to appropriately control the fuel supply to suit the property of the actual fuel being used. Hence to ensure startability and running stability when fuel with different vaporization characteristics is used, it is necessary to supply an excess of fuel using fuel supply characteristics appropriate for the heavy grade fuel having the worst vaporization characteristic out of the fuels expected to be used. That is to say, fuel supply control appropriate for a heavy grade fuel is carried out until the fuel property is specified. Consequently, when a general light grade fuel is used, an excess of fuel is supplied during the interval from start-up until the fuel property is specified, resulting in an over rich air-fuel ratio and a consequent increase in the concentration of HC, and CO in the exhaust.

Since the fuel supply to the vehicle engine is carried out using the fuel stored in the fuel tank, then if there is no change in the property of this fuel, the property of the fuel supplied to the engine can be considered unchanged. However, when the engine is stopped, since there is the possibility of refueling the fuel tank with a fuel having different properties, fuel property detection has here to fore been carried out at each engine start-up provided that the fuel properties are uncertain. Accordingly, it has been desirable to improve the exhaust properties during the period from start-up until the fuel properties are specified.

Moreover, while in general the fuel tank is refueled when the engine is stopped, it may be refueled when the engine is operating. Hence, in this case there may be an error in the detection results for the fuel property immediately after engine start-up due to the refueling, so that when for example the fuel quantity increase correction amount for acceleration is corrected in accordance with the fuel properties, then proper quantity increase correction control will not be carried out.

SUMMARY OF THE INVENTION

In view of the above situation, it is an object of the present invention to provide an apparatus and method for detecting refueling of a vehicle engine, which can appropriately and accurately detect the presence or absence of fuel tank refueling which may involve a change in fuel properties.

Furthermore, it is an object of the present invention to provide an apparatus and method for supplying fuel to a vehicle engine, which can give a greater opportunity to carry out fuel supply quantity control corresponding to the property of the fuel actually being used, and thereby reduce deterioration in exhaust properties due to a fuel supply quantity inappropriate for the fuel property.

To achieve the above objects, an apparatus according to the present invention for detecting refueling of a vehicle engine, which outputs a detection signal indicating the presence or absence of refueling of a fuel tank from which fuel is supplied to the engine, comprises; a remaining quantity sensor for detecting a remaining fuel quantity inside the fuel tank, and a refueling detection device for outputting a refueling signal indicating that the fuel tank has been refueled, when an increase change in the remaining fuel quantity detected by the remaining quantity sensor is equal to or greater than a predetermined proportion of a remaining fuel quantity before the increase change.

With such a construction, refueling is detected when the remaining fuel quantity inside the fuel tank increases due to refueling, to the extent that the resultant increase change is equal to or greater than a predetermined proportion of the remaining fuel quantity before the change. That is to say, if refueling involves a fuel having different properties, but the quantity refueled is small compared to the quantity remaining in the tank, this is not regarded as refueling since the property of the fuel in the fuel tank will not be changed significantly due to the refueling.

The construction may be such that the refueling detection device stores a remaining fuel quantity value when an engine key switch is switched off, and outputs a refueling signal indicating that the fuel tank has been refueled when a difference between a remaining fuel quantity value for when the key switch is switched on, and the stored remaining fuel quantity value for when switched off is equal to or greater than a predetermined proportion of the stored remaining fuel quantity value for when switched off.

With such a construction, the amount of change in the remaining fuel quantity is the amount of change during the period from switching off the key switch (engine shut-down) until the subsequent switching on. Hence any increase in the amount of fuel in the fuel tank while the engine is stopped is detected, enabling the presence or absence of refueling while the engine is stopped to be detected.

Moreover, an apparatus for detecting refueling of a vehicle engine according to the present invention comprises; a refueling detection device for outputting a refueling signal indicating that the fuel tank has been refueled, when a condition wherein an increase change per unit time in the remaining fuel quantity detected by the remaining quantity sensor is equal to or greater than a predetermined value, continues for more than a predetermined time.

With such a construction, the increase change in the remaining fuel quantity per unit time is detected, and when an increase change greater than a predetermined value continues for equal to or more than a predetermined time, then the increase change in the remaining fuel quantity is considered to be due to refueling. Here, the proviso of continuation for equal to or more than a predetermined time is to distinguish between a change in remaining fuel quantity due to refueling and a change in the detected quantity of remaining fuel due for example to vehicle travelling conditions involving ascent or descent of a slope.

Furthermore, an apparatus for detecting refueling of a vehicle engine according to the present invention comprises; a refueling detection device for outputting a refueling signal indicating that the fuel tank has been refueled when a pressure inside the fuel tank detected by a tank pressure sensor is approximately equal to atmospheric pressure.

With such a construction, it is assumed that when the pressure inside the fuel tank is approximately equal to atmospheric pressure, then the filler cap (fuel tank refueling inlet cover) has been opened for refueling. Refueling is thus detected as the opening of the filler cap for refueling.

With regards to another aspect of the invention, an apparatus according to the present invention for supplying fuel to a vehicle engine from a fuel tank comprises; a refueling detection device for detecting the presence or absence of refueling of the fuel tank, a fuel property detection device for indirectly detecting a fuel property based on engine operating conditions, a fuel property storage device for storing and holding a fuel property detected by the fuel property detection device while the engine is stopped, and a start-up fuel supply control device for supplying to the engine a quantity of fuel corresponding to the fuel property stored in the fuel property storage device, when detected by the refueling detection device that refueling has not been carried out While the engine is stopped, and for supplying to the engine a quantity of fuel corresponding to a previously set reference fuel property when detected by the refueling detection device that refueling has been carried out while the engine is stopped.

With such a construction, a device is provided for indirectly detecting a fuel property based on engine operating conditions, and the fuel property detected by the device is stored and held while the engine is stopped. The presence or absence of refueling while the engine is stopped is then determined at the time of restarting, and when refueling has not been carried out, it is judged that there is also no change in the fuel property, and the fuel supply at start-up is controlled corresponding to the fuel property stored and held while the engine was stopped. On the other hand, when refueling is carried out while the engine is stopped, there is a possibility of a change to a fuel property different from the stored fuel property, due to the refueling. Therefore since the fuel property is uncertain, the fuel supply characteristics at start-up are made to correspond to a previously set reference fuel property.

The construction may be such that the refueling detection device stores a value for the remaining fuel quantity in the fuel tank when the engine key switch is switched off, and outputs a refueling signal indicating that the fuel tank has been refueled when a difference between a remaining fuel quantity value for when the key switch is switched on and the stored remaining fuel quantity value for when switched off is equal to or greater than a predetermined proportion of the stored remaining fuel quantity value for when switched off.

With such a construction, it can be detected whether or not refueling with a quantity sufficient to change the fuel property has been carried out while the engine is stopped.

Moreover, the construction may be such that the refueling detection device outputs a refueling signal indicating that the fuel tank has been refueled when a pressure inside the fuel tank is approximately equal to atmospheric pressure.

With such a construction, when the filler cap is opened so that the pressure inside the tank is approximately equal to atmospheric pressure, it can be considered that the filler cap has been opened for refueling.

Furthermore, the construction may be such that the fuel property detection device detects a fuel vaporization characteristic as the fuel property, based on a change in combustion conditions when the engine fuel supply quantity is forcibly changed.

With such a construction, the fuel supply quantity is forcibly corrected, and the fuel vaporization characteristic is detected based on a delay until the influence of the correction appears as a change in combustion conditions.

In addition, an apparatus according to the present invention for supplying fuel to a vehicle engine from a fuel tank comprises; a fuel property detection device for indirectly detecting a fuel property based on engine operating conditions, a fuel supply control device for supplying to the engine a quantity of fuel corresponding to the fuel property detected by the fuel property detection device, a refueling detection device for detecting the presence or absence of refueling of the fuel tank, and a fuel property updating device for repeating fuel property detection by the fuel property detection device and updating the fuel property, when refueling is detected by the refueling detection device during engine operation subsequent to detection of the fuel property by the fuel property detection device.

With such a construction, when refueling is carried out during engine operation subsequent to detection of the fuel property, fuel property detection is repeated. Therefore if refueling is carried out during engine operation, the detection value of the fuel property is not left in the condition before refueling.

Here the construction may be such that the refueling detection device outputs a refueling signal indicating that the fuel tank has been refueled, when a condition wherein an increase change per unit time in a remaining fuel quantity in the fuel tank is equal to or greater than a predetermined value, continues for more than a predetermined time.

With such a construction, refueling during engine operation is detected by distinguishing this from a change in remaining fuel quantity due for example to vehicle travelling conditions involving ascent or descent of a slope.

Moreover, the construction may be such that the refueling detection device outputs a refueling signal indicating that the fuel tank has been refueled when a pressure inside the fuel tank is approximately equal to atmospheric pressure.

With such a construction, when the filler cap is opened so that the pressure inside the fuel tank is approximately equal to atmospheric pressure, it can be considered that the filler cap has been opened for refueling.

Furthermore, the construction may be such that the fuel property detection device detects a fuel vaporization characteristic as the fuel property, based on a change in combustion conditions when the engine fuel supply quantity is forcibly changed.

With such a construction, the fuel supply quantity is forcibly corrected, and the fuel vaporization characteristic is detected based on a delay until the influence of the correction appears as a change in combustion conditions.

With regards to another aspect of the invention, a method of detecting refueling of a vehicle engine according to the present invention includes; outputting a refueling signal indicating that a fuel tank has been refueled, when a difference between a remaining fuel quantity in the fuel tank when a key switch is switched off and a remaining fuel quantity in the fuel tank when the key switch is switched on is equal to or greater than a predetermined proportion of the remaining fuel quantity when the key switch was switched off.

With such a construction, refueling detection is carried out only when refueling with a quantity of fuel sufficient to change the fuel property has been carried out while the engine is stopped.

Moreover, a method of detecting refueling of a vehicle engine according to the present invention includes; outputting a refueling signal indicating that a fuel tank has been refueled, when a condition wherein an increase change per unit time in a remaining fuel quantity in the fuel tank is equal to or greater than a predetermined value, continues for more than a predetermined time.

With such a construction, refueling during engine operation is detected by distinguishing this from a change in remaining fuel quantity due for example to vehicle travelling conditions involving ascent or descent of a slope.

Furthermore, a method of detecting refueling of a vehicle engine according to the present invention includes; outputting a refueling signal indicating that a fuel tank has been refueled, when a pressure inside the fuel tank is approximately equal to atmospheric pressure.

With such a construction, when the filler cap is opened so that the pressure inside the fuel tank is approximately equal to atmospheric pressure, it can be considered that the filler cap has been opened for refueling.

In addition, a method of supplying fuel to a vehicle engine according to the present invention includes; detecting whether or not refueling of a fuel tank has been carried out while the engine is stopped, and when refueling has been carried out, indirectly detecting a fuel property based on engine operating conditions, and updating the fuel property, and during a period until completion of the updating of the fuel property, supplying to the engine a quantity of fuel corresponding to a previously set reference fuel property, and after completion of the updating of the fuel property, supplying to the engine a quantity of fuel corresponding to the updated fuel property, while when refueling has not been carried out while the engine is stopped, supplying to the engine from the time of start-up, a quantity of fuel corresponding to a fuel property which has been stored and held while the engine was stopped.

With such a construction, when refueling is not carried out while the engine is stopped, then the fuel property does not change so that a quantity of fuel corresponding to the fuel property can be supplied immediately after start-up.

Here the construction may be such that the presence or absence of refueling is detected based on at least one of a change in a remaining fuel quantity inside the fuel tank, and a pressure inside the fuel tank.

With such a construction, refueling can be detected based on an increase change in the remaining fuel quantity, or based on the pressure inside the fuel tank being approximately equal to atmospheric pressure.

Moreover, the construction may be such that a fuel vaporization characteristic is detected as the fuel property, based on a change in combustion conditions when the engine fuel supply quantity is forcibly changed.

With such a construction, the fuel supply quantity is forcibly corrected, and the fuel vaporization characteristic is detected based on a delay until the influence of the correction appears as a change in combustion conditions.

Furthermore, a method of supplying fuel to a vehicle engine according to the present invention includes; detecting the presence or absence of refueling of a fuel tank at least during engine operation, and each time refueling is detected, indirectly detecting a fuel property based on engine operating conditions, updating the fuel property, and supplying a quantity of fuel to the engine corresponding to the latest updated fuel property.

With such a construction, when refueling is carried out during engine operation, the fuel supply quantity can be changed in accordance with the change in fuel property due to the refueling, to a quantity to suit the fuel property.

Here the construction may be such that the presence or absence of refueling is detected based on at least one of; a change in a remaining fuel quantity inside the fuel tank, and a pressure inside the fuel tank.

With such a construction, refueling can be detected based on an increase change in the remaining fuel quantity, or based on the pressure inside the fuel tank being approximately equal to atmospheric pressure.

Moreover, the construction may be such that a fuel vaporization characteristic is detected as the fuel property, based on a change in combustion conditions when the engine fuel supply quantity is forcibly changed.

With such a construction, the fuel supply quantity is forcibly corrected, and the fuel vaporization characteristic is detected based on a delay until the influence of the correction appears as a change in combustion conditions.

Further objects and aspects of the present invention will become apparent from the following description of the embodiments given in conjunction with the appended drawings.

DESCRIPTION OF THE PREFERRED EMBODIMENTS

As follows is a description of embodiments of the present invention.

Figure 3:
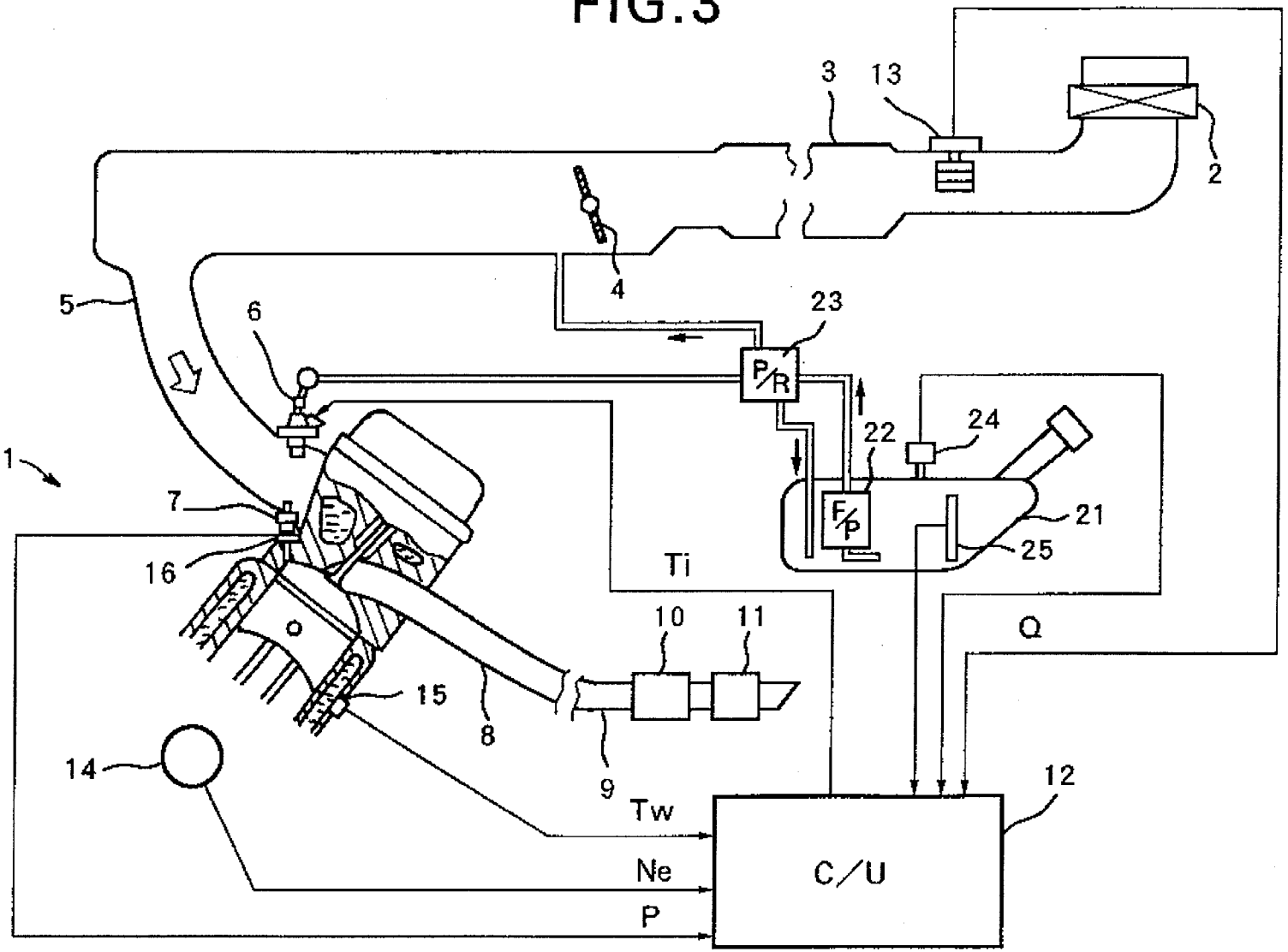
FIG. 3 is a schematic system diagram illustrating an embodiment of the present invention.

With the embodiment shown in FIG. 3, a vehicle engine 1 draws in air from an air cleaner 2 by way of an intake duct 3, a throttle valve 4, and an intake manifold 5. Fuel injection valves 6 are provided for each cylinder in respective branch portions of the intake manifold 5.

The fuel injection valves 6 are solenoid type fuel injection valves which open with power to a solenoid and close with power shut-off. The injection valves 6 are driven open in response to a drive pulse signal provided by a control unit 12 (to be described later) so that fuel pressurized by a fuel pump 22 provided inside a fuel tank 21, and controlled to a predetermined pressure by means of a pressure regulator 23, is injected intermittently to the engine 1.

The pressure regulator 23 adjusts the pressure of the fuel to keep a constant pressure difference between the negative engine intake pressure and the fuel pressure, by returning fuel to the fuel tank 21 when the fuel pressure is equal to or higher than a predetermined value above the negative intake pressure.

Ignition plugs 7 are provided for each combustion chamber of the engine 1 for spark ignition of a mixture inside the cylinders. Exhaust from the engine 1 is discharged by way of an exhaust manifold 8, an exhaust duct 9, a catalytic converter 10, and a muffler 11.

The control unit 12 provided for electronically controlling the fuel supply to the engine, incorporates a microcomputer having a CPU, ROM, RAM, A/D converter and input/output interface. Input signals from various sensors are input to the control unit 12, and computational processing carried out (as described later) to thereby control the operation of the fuel injection valves 6.

For the various sensors there is provided in the intake duct 3, an airflow meter 13, which outputs a signal corresponding to an intake air quantity Q of the engine 1.

Also provided is a crank angle sensor 14 which outputs a reference crank angle signal REF for each reference angle position (for example for each TDC), and a unit crank angle signal POS for each 1° or 2° of crank angle. The period of the reference crank angle signal REF or the number of unit crank angle signals POS within a predetermined period is measured to compute the engine rotational speed Ne.

A water temperature sensor 15 is provided for detecting the cooling water temperature Tw in the water jacket of the engine 1.

Cylinder pressure sensors 16 of the ignition plug washer type such as disclosed in Japanese Unexamined Utility Model Publication No. 63-17432, are provided for each ignition plug 7, to thereby detect the cylinder pressure of each cylinder. The pressure sensors 16 comprise ring shaped piezo electric elements or electrodes, which are clamped between the ignition plug 7 and the cylinder head.

Instead of the above mentioned ignition plug washer type cylinder pressure sensor 16, a type having a sensor portion facing directly into the combustion chamber to detect cylinder pressure as an absolute pressure is also possible.

The fuel tank 21 is provided with a tank pressure sensor 24 for detecting the tank pressure, and a remaining quantity sensor 25 for detecting the remaining fuel quantity inside the fuel tank 21.

The CPU of the microcomputer in the control unit 12 carries out computational processing in accordance with a program stored in the ROM, to compute the fuel injection quantity Ti (injection pulse width) for the engine 1, and output to the fuel injection valves 6 at a predetermined injection timing, a drive pulse signal having a pulse width corresponding to the fuel injection quantity Ti (fuel supply quantity).

The fuel injection quantity Ti is computed as:

Fuel injection quantity *Ti*=basic injection quantity *Tp*×various correction coefficients *Co*+voltage correction amount *Ts*

The basic injection quantity Tp is a basic injection quantity determined based on the intake air quantity Q and the engine rotational speed Ne. The voltage correction amount Ts is a correction amount to counteract an increase in unavailable injection quantity due to a drop in battery voltage.

The various correction coefficients Co are computed as Co={1+air-fuel ratio correction coefficient $K_{MR}$+correction coefficient $K_{TW}$ for an increase based on water temperature+correction coefficient $K_{AS}$ for an increase after start-up+correction coefficient $K_{ACC}$ for an increase with acceleration+correction coefficient $K_{DC}$ for a reduction with deceleration+. . . . }

The air-fuel ratio correction coefficient $K_{MR}$ is a coefficient for correcting the basic injection quantity Tp to give an optimum air-fuel ratio with respect to the engine rotational speed Ne and the basic injection quantity Tp (engine load). The correction coefficient $K_{TW}$ for an increase based on water temperature, increasingly corrects the injection quantity the lower the cooling water temperature Tw. The correction coefficient $K_{AS}$ for an increase after start-up increasingly corrects the injection quantity immediately after start-up, the lower the cooling water temperature Tw, and gradually decreases the increase correction quantity in a predetermined proportion until this finally becomes zero. The correction coefficient $K_{ACC}$ for an increase with acceleration, and the correction coefficient $K_{DC}$ for a reduction with deceleration are for respectively increasingly/decreasingly correcting the injection quantity so as to avoid variations in air-fuel ratio at the time of engine acceleration/deceleration.

At the time of start-up (cranking) the basic injection quantity (start-up injection pulse width) is set in correspondence with the cooling water temperature Tw, without using the intake air quantity Q detected by the airflow meter 13.

Aspects of the injection control by the control unit 12 will now be described in accordance with the flow charts of FIG. 4 and FIG. 5.

Figure 1:
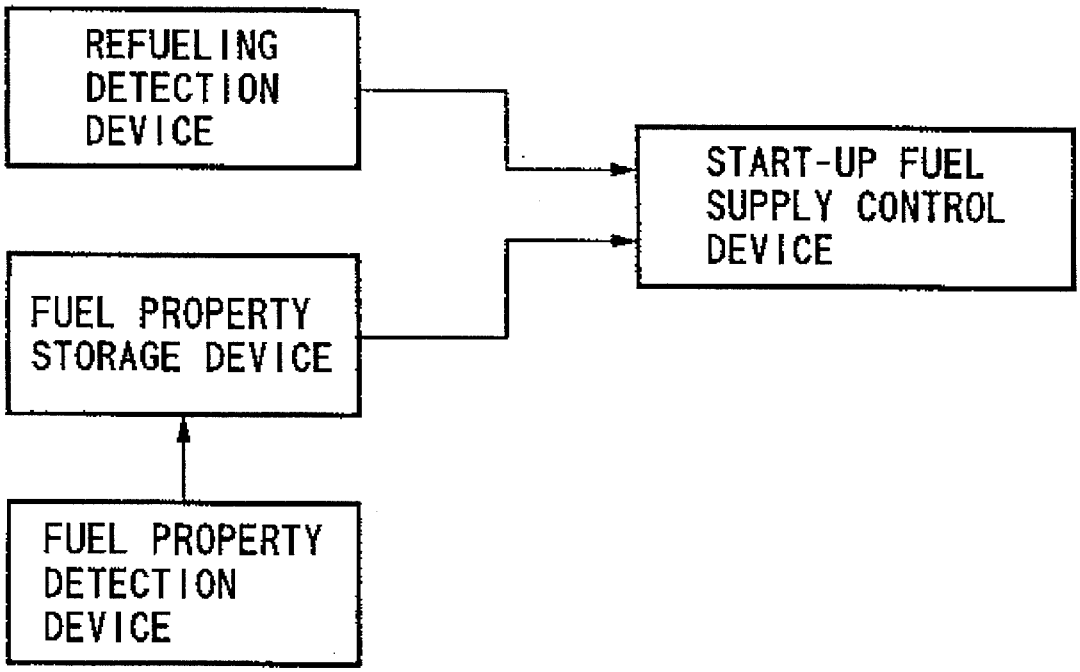
FIG. 1 is a block diagram showing a basic construction of a vehicle engine fuel supply apparatus according to an aspect of the present invention.
Figure 2:
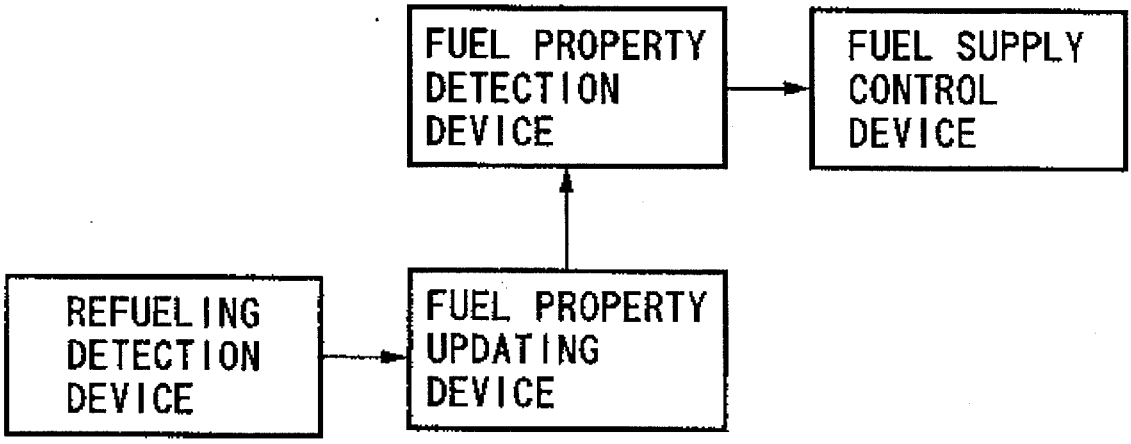
FIG. 2 is a block diagram showing a basic construction of a vehicle engine fuel supply apparatus according to another aspect of the present invention.
Figure 4:
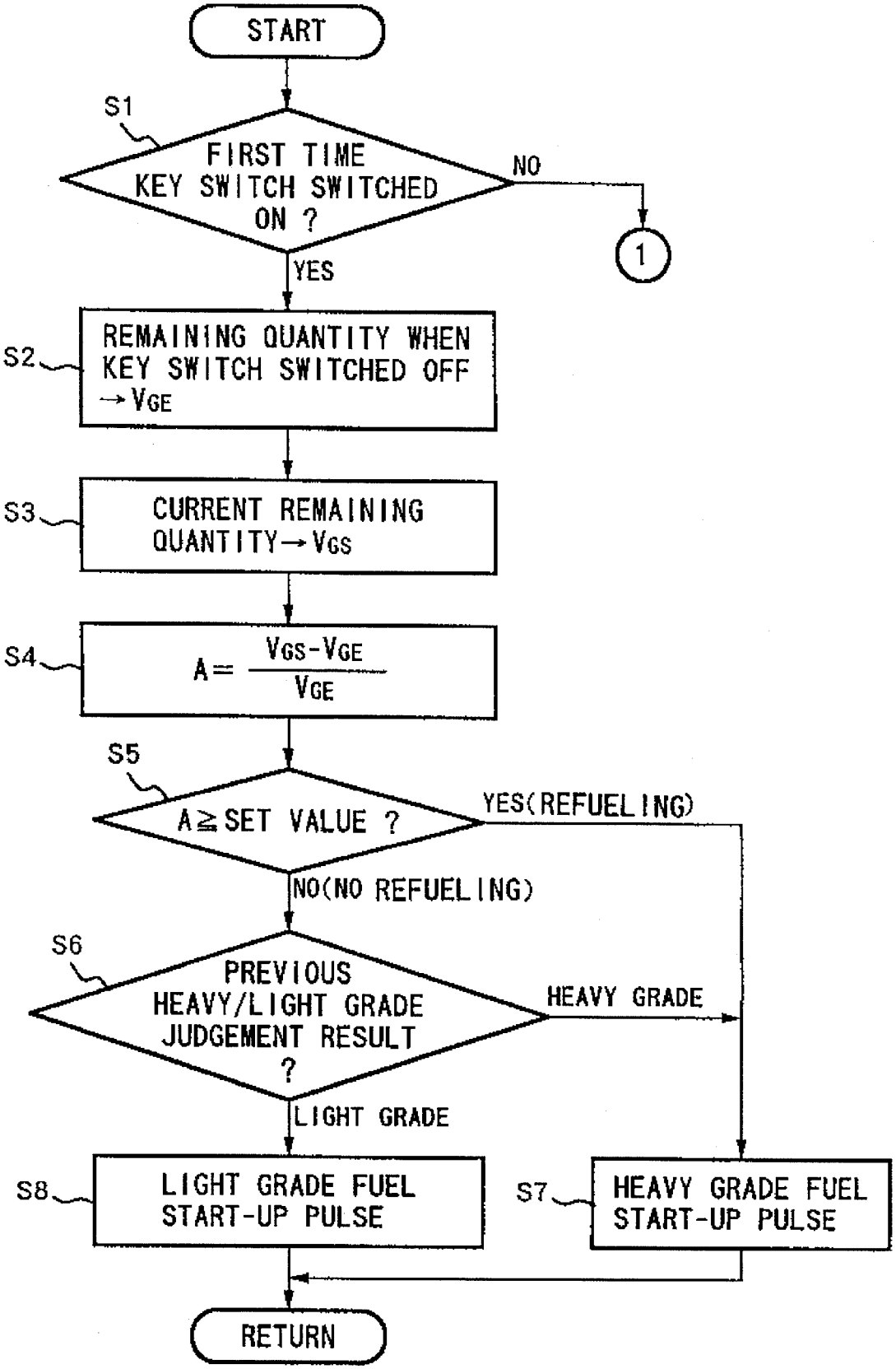
FIG. 4 is a flow chart showing a fuel injection control routine for the embodiment.
Figure 5:
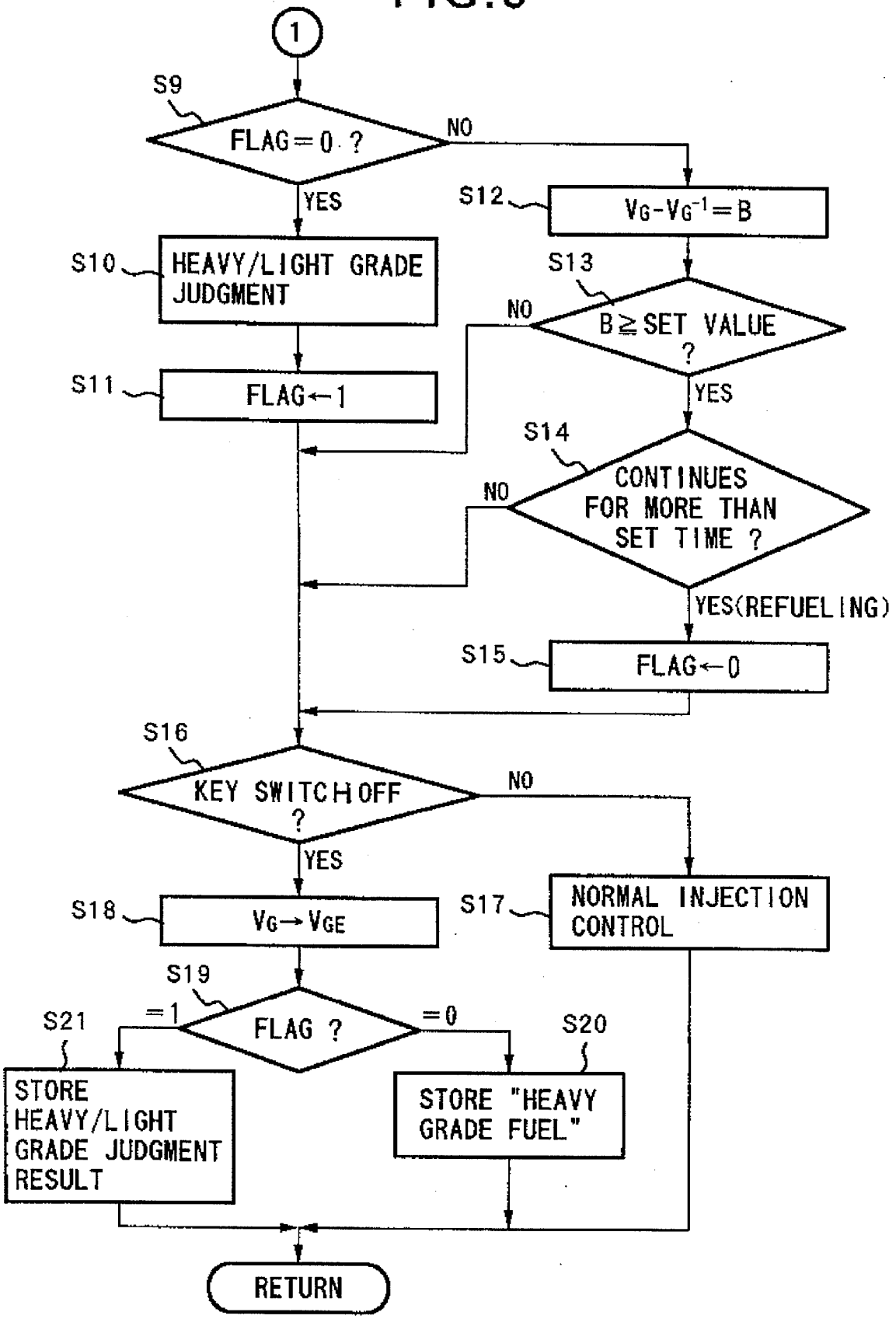
FIG. 5 is a flow chart showing another fuel injection control routine for the embodiment.

In the present embodiment, the functions of a refueling detection device, a fuel property detection device, a fuel property storage device, a start-up fuel supply control device (see FIG. 1), and a refueling detection device, a fuel property detection device, a fuel supply control device, and a fuel property updating device (see FIG. 2), are realised by software illustrated by the flow charts of FIG. 4 and FIG. 5 and stored in the control unit 12.

In the flow charts of FIG. 4 and FIG. 5, initially in step 1 (with "step" denoted by S in FIGS. 4 and 5) it is judged if a key switch (not shown) has been switched from off to on for the first time.

If so, control proceeds to step 2 where a remaining fuel quantity $V_{GE}$ for the fuel tank 21, which was stored at the termination of the previous engine operation and held while the key switch was off, is read.

Then in the step 3, a detection value (sensor output) $V_G$ from the remaining quantity sensor 25 for the remaining fuel quantity at the current point in time is read, and set to $V_{GS}$ as the remaining fuel quantity at start-up.

In step 4, the amount of change in the remaining fuel quantity while the engine is stopped is obtained from a difference between the remaining fuel quantity at start-up $V_{GS}$, and the remaining fuel quantity $V_{GE}$ at termination of the previous engine operation. A ratio A of the change amount ($V_{GS}-V_{GE}$) and the remaining fuel quantity $V_{GE}$ at termination of the previous engine operation is then computed ($A=(V_{GS}-V_{GE})/V_{GE}$).

The ratio A shows the proportion of the increase in quantity with respect to the remaining fuel quantity $V_{GE}$ at termination of the previous engine operation. When the fuel tank 21 is not refueled while the engine is stopped so that the remaining fuel quantity does not change, the ratio A becomes zero, while when the fuel tank 21 is refueled, then the value of the ratio A becomes larger, the larger the proportion of the refueled quantity with respect to the quantity of fuel remaining before refueling (while the engine is stopped).

In step 5, it is determined if the ratio A is greater than or equal to a predetermined value. If so, it is judged that the fuel tank 21 has been refueled while the engine was stopped, and a refueling signal indicating that refueling has been carried out is output. On the other hand, when determined in step 5 that the ratio A is less than the predetermined value, it is judged that refueling has not been carried out while the engine was stopped, and a non-refueling signal is output.

Here the condition where the ratio A is less than the predetermined value, also includes the case where refueling has been carried out but the refueling quantity was only a small proportion of the remaining fuel. In this case, even though the refueling may involve a different grade of fuel, since the influence of the refueling will be small it can be assumed that the change in fuel property is practically zero. Therefore this is included with the case for no refueling. More specifically, the detection of the presence or absence of refueling based on the ratio A is to detect whether or not the property of the fuel in the fuel tank 21 may have been changed by the refueling (to be described later). Therefore, even though there may have been refueling, if the quantity would have no influence on the fuel property, it is treated the same as for when refueling has not been carried out.

In step 5, when the refueling signal indicating that refueling has been carried out while the engine is stopped is output, there is the possibility that the fuel refueled has either the same property or a different property to that of the fuel in the fuel tank 21 prior to refueling. Therefore, due to the refueling while the engine is stopped the properties of the fuel inside the fuel tank are uncertain. Consequently, when for example the current fuel inside the fuel tank 21 is a heavy grade fuel having comparatively poor volatility, then if an injection quantity suitable for a normal light grade fuel having comparatively good volatility is set at the time of start-up, there will be a deterioration in startability.

Accordingly, when refueling involving an amount of fuel sufficient to change the fuel property is carried out while the engine is stopped, thus making the fuel property (vaporization characteristic) uncertain, then to avoid for example poor starting due to insufficient fuel, control proceeds to step 7, where a pulse width which has been previously set to suit a heavy grade fuel (reference fuel property) is set as the injection pulse width for start-up which is set in accordance with the cooling water temperature Tw.

As a result, the occurrence of poor start-up due to an insufficient injection quantity can be avoided, irrespective of which fuel (of the fuels previously assumed to be used) is supplied while the engine is stopped.

When on the other hand in step 5, the ratio A is less than the predetermined value and a signal is output corresponding to the case wherein refueling has not been carried out while the engine is stopped, or refueling has been carried out but the proportion of fuel has not been sufficient to change the fuel property, control proceeds to step 6. In step 6, it is judged if the fuel property detected at the time the previous engine operation, and stored and held while the engine was stopped is for heavy grade fuel or for normal light grade fuel.

When judged to be for heavy grade fuel, control proceeds to step 7 where a start-up injection pulse width appropriate for heavy grade fuel is set, while when judged to be for normal light grade fuel, control proceeds to step 8 where a start-up injection pulse width previously set as appropriate for light grade fuel is set.

Figure 6:
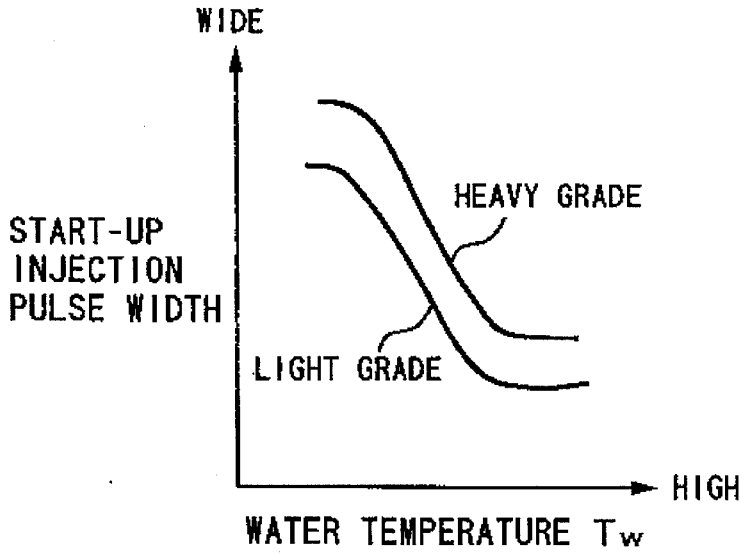
FIG. 6 is a graph showing a correlation between heavy and light grade fuel, and injection pulse width at start-up.

As shown in FIG. 6, the start-up injection pulse width appropriate for light grade fuel is set shorter for a smaller required quantity compared to the start-up injection pulse width appropriate for the heavy grade fuel. As a result, since the fuel inside the fuel tank 21 is a light grade fuel, then the larger quantity of fuel appropriate for heavy grade fuel is not injected at start-up, so that the HC and CO emissions at start-up can be kept to a sufficiently low level.

In this way, with the present embodiment, when refueling with a quantity sufficient to change the property of the fuel in the fuel tank 21 is not carried out while the engine is stopped, it is judged that the fuel property at the time of the previous engine operation has not changed. The fuel injection at start-up is therefore controlled to a characteristic appropriate for the fuel property detected at that time.

In particular with the present embodiment, even if refueling has been carried out but the property of the fuel can be assumed to have not been changed significantly due to the refueling, then as with the case for no refueling, the fuel injection quantity at start-up is controlled to correspond to the fuel property detected at the time of the previous operation. The opportunity to carry out injection control at start-up appropriate for the actual fuel being used can thus be increased.

Referring back to the key switch operation of step 1, when the key switch remains on (including both engine operating and stopped conditions), control proceeds from step 1 to step 9, where judgment is made of a flag indicating if detection of the fuel property (heavy/light grade) has been completed.

A flag setting of "0", indicates that detection of the fuel property has not been completed. When judged in step 9 that the flag is "0", control proceeds to step 10 where processing is carried out to indirectly detect the fuel property based on forcible correction of the fuel injection quantity and detection of the combustion conditions at the time of the correction. Details of fuel property detection in step 10 are given later.

The flag may be reset to "0" each time the key switch is switched off. The flag may also be reset to "0" only when the refueling detection is carried out in step 5.

The flag is set to "1" in step 11 once fuel property detection has been carried out in step 10, so that the completion of fuel property detection can be determined from the flag.

Control then proceeds to step 16 where it is judged if the engine has stopped by noting if the key switch is off. If the engine continues to operate, control proceeds to step 17 where normal injection control is carried out based on the computation for the injection quantity Ti explained beforehand. With normal injection control, once fuel property detection has been completed, the fuel correction quantity for acceleration/deceleration and the fuel correction quantity corresponding to water temperature may be corrected corresponding to the fuel property detection result.

When judged in step 9 that the flag has been set to "1", control proceeds to step 12, where a difference B between the detection value $V_G$ from the remaining quantity sensor 25 for the current point in time, and the detection value $V_G^{-1}$ for the previous time unit is computed.

In step 13, it is judged if the difference B is greater than or equal to a predetermined value, to thereby determine if an increase change in the remaining fuel quantity is greater than or equal to a predetermined quantity per unit time.

Then in step 14, it is judged if the condition wherein the increase change in the remaining fuel quantity per the unit time is greater than or equal to a predetermined value, continues for more than a predetermined time.

If so, it is judged that refueling has been carried out while the engine is operating, and a refueling signal is output indicating that refueling has been carried out.

During vehicle running, the remaining fuel quantity detected by the remaining quantity sensor 25 may change momentarily with ascent/descent of a slope, or acceleration/deceleration. Therefore to distinguish this from a change in remaining quantity accompanying refueling while the engine is operating, the continuation of the increase change in remaining quantity above a constant rate for more than or equal to a predetermined time is made a proviso for detecting refueling during engine operation.

More specifically, at the time of refueling, the remaining fuel quantity continuously increases at a constant rate, in contrast to the temporary or unstable change in the remaining quantity detection value at the time of ascent/descent of a slope or acceleration/deceleration. Therefore by making continuation for a predetermined time a proviso, a change in the remaining quantity detection value at the time of ascent/descent of a slope or deceleration/acceleration can be distinguished from the change due to refueling.

When the increase change in remaining fuel quantity continues above a constant rate for more than a predetermined time thereby indicating refueling while the engine is running, then since there is the possibility of a change in fuel properties due to the refueling, control proceeds to step 15 where the flag is reset to "0".

On the other hand, when the judgments of step 13 and step 14 are for non-detection of refueling during engine operation, control proceeds to step 16, by-passing step 15.

The refueling detection steps 2 through 5, only detect refueling while the engine is stopped. Therefore if the processing of steps 12 through 15 are not followed, and refueling is carried out while the engine is running after detecting the fuel property, and the engine then stopped without taking the opportunity to update the fuel property, then the detection result for before the refueling will remain stored while the engine is stopped. On the other hand, if the processing of steps 12 through 15 according to this embodiment is provided, then when refueling is carried out, fuel property detection can be reliably repeated. Hence wasteful fuel property detection can be avoided, while still maintaining correspondence with changes in fuel properties due to refueling while the engine is operating.

The fuel property is thus detected as described above while the engine is running, and when the key switch is switched off, control proceeds from step 16 to step 18.

In step 18, the detection value $V_G$ from the remaining quantity sensor 25 for when the key switch was switched off, is set as the remaining quantity $V_{GE}$ for when the engine is stopped, so as to detect refueling while the engine is stopped in steps 2 through 5. This remaining quantity $V_{GE}$ remains stored (while the engine is stopped) until the key switch is next switched on. As a result, any changes in the remaining fuel quantity when the engine is stopped can be detected in steps 2 through 5.

Judgment of the flag is carried out in the next step 19, to determine if the engine was stopped with fuel property detection having been completed.

When the flag is "0", that is the engine was stopped without having had the chance to carry out fuel property detection, control proceeds to step 20 where "heavy grade fuel" is stored as the detection result for the fuel property, so that at least at the time of the next start-up, starting is not compromised due to an insufficient fuel injection quantity.

On the other hand, when the flag is "1" for fuel property detection having been carried out, control proceeds to step 21 where the fuel property detection result is stored.

The fuel property stored in step 20 or step 21 is stored and held while the engine is stopped using a backup power supply, so that if detected in step 5 that there has been no refueling while the engine is stopped, the stored data is referred to in the next step 6 to set the fuel injection pulse width for start-up.

With the abovementioned embodiment, refueling while the engine is stopped and during engine operation, is detected based on the detection results of the remaining quantity sensor 25. The presence or absence of refueling may however be detected based on the pressure inside the tank detected by the tank pressure sensor 24.

More specifically, when the filler cap is opened for refueling, the pressure inside the fuel tank 21 changes from a negative pressure to atmospheric pressure. Therefore when the pressure inside the fuel tank 21 detected by the tank pressure sensor 24 approaches atmospheric pressure, it can be assumed that the filler cap has been opened for refueling.

Figure 7:
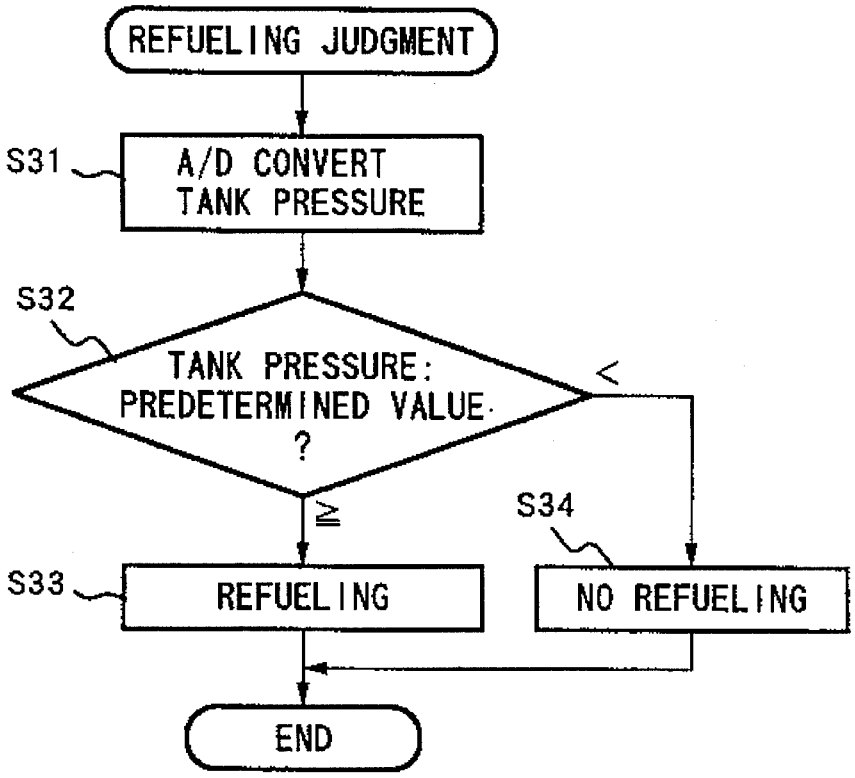
FIG. 7 is a flow chart showing a refueling detection routine based on tank pressure.

The flow chart of FIG. 7 shows an aspect of refueling detection using the tank pressure (refueling detection device). In step 31, a detection signal of the tank pressure sensor 24 is A/D converted and then read.

In step 32, it is judged if the tank pressure read in step 31 is greater than or equal to a predetermined value. The judgment of step 32 involves judging if the tank pressure has changed from a negative pressure to atmospheric pressure due to opening the filler cap.

When judged in step 32 that the tank pressure is greater than or equal to the predetermined value, control proceeds to step 33 where it is assumed that the increase in tank pressure is due to opening the filler cap for refueling, and a refueling signal is output indicating that refueling has been carried out.

On the other hand, when judged in step 32 that the tank pressure is less than the predetermined value, control proceeds to step 34 where it is assumed that the pressure inside the fuel tank 21 is remaining at the negative pressure because the filler cap has not been opened for refueling, and a non-refueling signal is output indicating that refueling has not been carried out.

Here the presence or absence of refueling while the engine is stopped may be determined by A/D converting and reading the detection value of the tank pressure sensor 24 when the key switch is first switched on. Moreover, the presence or absence of refueling while the engine is running may be determined by A/D converting and reading the detection signal of the tank pressure sensor 24 at predetermined periods.

The heavy/light grade fuel detection of step 10 of the flow chart of FIG. 5 (fuel property detection) may be carried out as described below.

In the case of heavy grade fuel with a poor vaporization rate, then compared to a normal light grade fuel, there is a large response delay from a change in the fuel quantity supplied to the intake system until the actual air-fuel ratio of the mixture drawn into the cylinder changes.

Accordingly, to detect the fuel property, the fuel injection quantity for example is forcibly increased or decreased in steps, and the time required until a change in combustion pressure (engine operating conditions) corresponding to the step change is detected by the cylinder pressure sensor 16, is measured. A response delay can thus be determined from the measured time (correlation between forcible correction of the fuel quantity and combustion pressure change). The vaporization characteristic of the fuel can then be indirectly detected by noting that if the response delay is longer then a lower vaporization rate fuel is being used.

Moreover, a difference in response delay due to a difference in vaporization rate can be determined by forcibly changing the fuel injection quantity at constant periods, and comparing the combustion pressure change period (engine operating condition) detected at this time by the cylinder pressure sensor 16, with the injection quantity change period (detecting the correlation between forcible correction of the fuel quantity and the combustion pressure change). The vaporization characteristic of the fuel can thus be indirectly detected. In this case a response delay can be shown since, the lower the vaporization rate the longer the combustion pressure change period with respect to the injection quantity change period. The vaporization characteristic of the fuel can thus be indirectly detected by noting that if the combustion pressure change period is longer compared to the injection quantity change period, then a lower vaporization rate fuel is being used.

Furthermore, the fuel property (vaporization characteristic) can be indirectly detected by detecting a difference in air-fuel ratio in the normal combustion limit due to a difference in fuel vaporization rate, rather than by detecting the response delay of the air-fuel ratio change occurring in the cylinder due to the difference in vaporization rate. When the fuel is a heavy grade fuel with a poor vaporization rate, then a permissible reduction in the air-fuel ratio (enriching) is greater than that for a light grade fuel with a comparatively good vaporization rate. Moreover the air-fuel ratio for the rich combustion limit is smaller than that for when a light grade fuel is used. On the other hand, the permissible increase in the air-fuel ratio (lean change) is smaller than that for a light grade fuel, and the air-fuel ratio for the lean combustion limit is smaller than that for when a light grade fuel is used. That is to say, with the heavy grade fuel, the air-fuel ratio limits to maintain normal combustion conditions are more to the rich side compared to those for a light grade fuel.

Accordingly, the fuel injection quantity is forcibly and gradually increased or decreased while monitoring the combustion pressure detected by the cylinder pressure sensor 16, and the injection quantity at the point in time when the change in combustion pressure exceeds a predetermined value (air-fuel ratio) is obtained as a combustion limit air-fuel ratio. The vaporization characteristic of the fuel can then be indirectly detected depending on whether there is a rich trend or a lean trend in the detected combustion limit air-fuel ratio.

With the abovementioned embodiments, refueling is detected based on the remaining fuel quantity detected by the remaining quantity sensor 25, or based on the tank pressure detected by the tank pressure sensor 24. However it is also possible to carry out both refueling detections in parallel, and determine that actual refueling has been carried out only when detected by both.

Moreover, as well as using the heavy/light grade fuel detection results for correction of the injection quantity, these results may also be used for other purposes, such as for ignition timing control.

What is claimed is:

1. An apparatus for detecting refueling of a vehicle engine, which outputs a detection signal indicating the presence or absence of refueling of a fuel tank from which fuel is supplied to the engine, said apparatus comprising;

a remaining quantity sensor for detecting a remaining fuel quantity inside said fuel tank, and refueling detection means for outputting a refueling signal indicating that said fuel tank has been refueled, when an increase change in the remaining fuel quantity detected by said remaining quantity sensor is equal to or greater than a predetermined proportion of the remaining fuel quantity before the increase change.

2. An apparatus for detecting refueling of a vehicle engine according to claim 1, wherein said refueling detection means stores a remaining fuel quantity value when an engine key switch is switched off, and outputs a refueling signal indicating that said fuel tank has been refueled when a difference between a remaining fuel quantity value for when said key-switch is switched on, and said stored remaining fuel quantity value for when switched off is equal to or greater than a predetermined proportion of said stored remaining fuel quantity value for when switched off.

3. An apparatus for detecting refueling of a vehicle engine, which outputs a detection signal indicating the presence or absence of refueling of a fuel tank from which fuel is supplied to the engine, said apparatus comprising;

a remaining quantity sensor for detecting a remaining fuel quantity inside said fuel tank, and refueling detection means for outputting a refueling signal indicating that said fuel tank has been refueled, when a condition wherein an increase change per unit time in the remaining fuel quantity detected by said remaining quantity sensor is equal to or greater than a predetermined value, continues for more than a predetermined time.

4. An apparatus for detecting refueling of a vehicle engine, which outputs a detection signal indicating the presence or absence of refueling of a fuel tank from which fuel is supplied to the engine, said apparatus comprising;

a tank pressure sensor for detecting a pressure inside said fuel tank, and refueling detection means for outputting a refueling signal indicating that said fuel tank has been refueled, when a pressure inside said fuel tank detected by said tank pressure sensor is approximately equal to atmospheric pressure.

5. An apparatus for supplying fuel to a vehicle engine from a fuel tank said apparatus comprising;

refueling detection means for detecting the presence or absence of refueling of said fuel tank, fuel property detection means for indirectly detecting a fuel property based on engine operating conditions, fuel property storage means for storing and holding a fuel property detected by said fuel property detection means while the engine is stopped, and start-up fuel supply control means for supplying to the engine a quantity of fuel corresponding to the fuel property stored in said fuel property storage means, when detected by said refueling detection means that refueling has not been carried out while the engine is stopped, and for supplying to the engine a quantity of fuel corresponding to a previously set reference fuel property when detected by said refueling detection means that refueling has been carried out while the engine is stopped.

6. An apparatus for supplying fuel to a vehicle engine according to claim 5, wherein said refueling detection means stores a value for the remaining fuel quantity in the fuel tank when the engine key switch is switched off, and outputs a refueling signal indicating that said fuel tank has been refueled when a difference between a remaining fuel quantity value for when the key switch is switched on and the stored remaining fuel quantity value for when switched off is equal to or greater than a predetermined proportion of the stored remaining fuel quantity value for when switched off.

7. An apparatus for supplying fuel to a vehicle engine according to claim 5, wherein said refueling detection means outputs a refueling signal indicating that said fuel tank has been refueled when a pressure inside said fuel tank is approximately equal to atmospheric pressure.

8. An apparatus for supplying fuel to a vehicle engine according to claim 5, wherein said fuel property detection means detects a fuel vaporization characteristic as the fuel property, based on a change in combustion conditions when the engine fuel supply quantity is forcibly changed.

9. An apparatus for supplying fuel to a vehicle engine from a fuel tank said apparatus comprising;

fuel property detection means for indirectly detecting a fuel property based on engine operating conditions, fuel supply control means for supplying to the engine a quantity of fuel corresponding to the fuel property detected by said fuel property detection means, refueling detection means for detecting the presence or absence of refueling of said fuel tank, and fuel property updating means for repeating fuel property detection by said fuel property detection means and updating the fuel property, when refueling is detected by said refueling detection means during engine operation subsequent to detection of the fuel property by said fuel property detection means.

10. An apparatus for supplying fuel to a vehicle engine according to claim 9, wherein said refueling detection means outputs a refueling signal indicating that said fuel tank has been refueled, when a condition wherein an increase change per unit time in a remaining fuel quantity in said fuel tank is equal to or greater than a predetermined value, continues for more than a predetermined time.

11. An apparatus for supplying fuel to a vehicle engine according to claim 9, wherein said refueling detection means outputs a refueling signal indicating that said fuel tank has been refueled, when a pressure inside said fuel tank is approximately equal to atmospheric pressure.

12. An apparatus for supplying fuel to a vehicle engine according to claim 9, wherein said fuel property detection means detects a fuel vaporization characteristic as the fuel property, based on a change in combustion conditions when the engine fuel supply quantity is forcibly changed.

13. A method of detecting refueling of a vehicle engine including; outputting a refueling signal indicating that a fuel tank has been refueled, when a difference between a remaining fuel quantity in said fuel tank when a key switch is switched off and a remaining fuel quantity in said fuel tank when the key switch is switched on, is equal to or greater than a predetermined proportion of the remaining fuel quantity when the key switch was switched off.

14. A method of detecting refueling of a vehicle engine including; outputting a refueling signal indicating that a fuel tank has been refueled, when a condition wherein an increase change per unit time in a remaining fuel quantity in said fuel tank is equal to or greater than a predetermined value, continues for more than a predetermined time.

15. A method of detecting refueling of a vehicle engine including; outputting a refueling signal indicating that a fuel tank has been refueled, when a pressure inside said fuel tank is approximately equal to atmospheric pressure.

16. A method of supplying fuel to a vehicle engine including; detecting whether or not refueling of a fuel tank has been carried out while the engine is stopped, and when refueling has been carried out, indirectly detecting a fuel property based on engine operating conditions, and updating the fuel property, and during a period until completion of said updating of the fuel property, supplying to the engine a quantity of fuel corresponding to a previously set reference fuel property, and after completion of said updating of the fuel property, supplying to the engine a quantity of fuel corresponding to the updated fuel property, while when refueling has not been carried out while the engine is stopped, supplying to the engine from the time of start-up, a quantity of fuel corresponding to a fuel property which has been stored and held while the engine was stopped.

17. A method of supplying fuel to a vehicle engine according to claim 16, wherein the presence or absence of refueling is detected based on at least one of, a change in a remaining fuel quantity inside said fuel tank, and a pressure inside said fuel tank.

18. A method of supplying fuel to a vehicle engine according to claim 16, wherein a fuel vaporization characteristic is detected as the fuel property, based on a change in combustion conditions when the engine fuel supply quantity is forcibly changed.

19. A method of supplying fuel to a vehicle engine including detecting the presence or absence of refueling of a fuel tank at least during engine operation, and each time refueling is detected, indirectly detecting a fuel property based on engine operating conditions, updating the fuel property, and supplying a quantity of fuel to the engine corresponding to the latest updated fuel property.

20. A method of supplying fuel to a vehicle engine according to claim 19, wherein the presence or absence of refueling is detected based on at least one of a change in a remaining fuel quantity inside said fuel tank, and a pressure inside said fuel tank.

21. A method of supplying fuel to a vehicle engine according to claim 19, wherein a fuel vaporization characteristic is detected as the fuel property, based on a change in combustion conditions when the engine fuel supply quantity is forcibly changed.

* * * * *